US009302318B2

(12) United States Patent
Griffin

(10) Patent No.: US 9,302,318 B2
(45) Date of Patent: Apr. 5, 2016

(54) DEVICE AND METHOD FOR CONSTRUCTION OF BAFFLES FROM ENGINE BLOCK FREEZE PLUGS

(71) Applicant: Jim Griffin, Brush Prairie, WA (US)

(72) Inventor: Jim Griffin, Brush Prairie, WA (US)

(73) Assignee: Griffin Tactical Incorporated, Brush Prairie, WA (US)

( * ) Notice: Subject to any disclaimer, the term of this patent is extended or adjusted under 35 U.S.C. 154(b) by 0 days.

(21) Appl. No.: 14/590,226

(22) Filed: Jan. 6, 2015

(65) Prior Publication Data

US 2015/0143865 A1 May 28, 2015

Related U.S. Application Data

(60) Provisional application No. 62/091,622, filed on Dec. 14, 2014.

(51) Int. Cl.

| | |
|---|---|
| ***B21K 23/00*** | (2006.01) |
| ***G10K 11/16*** | (2006.01) |
| ***B21J 5/02*** | (2006.01) |
| ***B21D 22/00*** | (2006.01) |
| ***B21D 22/02*** | (2006.01) |
| ***B21D 22/21*** | (2006.01) |
| ***B21D 51/26*** | (2006.01) |

(52) U.S. Cl.

CPC ..... *B21K 23/00* (2013.01); *G10K 11/161* (2013.01); *B21D 22/00* (2013.01); *B21D 22/02* (2013.01); *B21D 22/21* (2013.01); *B21D 51/2646* (2013.01); *B21J 5/025* (2013.01)

(58) Field of Classification Search

CPC ..... B21K 23/00; B21K 1/30; B21K 21/12; B21J 5/025; B21J 5/12; B21J 5/06; B21J 5/08; B21J 5/10; B21J 9/00; B21J 9/02; B21J 9/04; B21J 13/02; B21J 13/025; B21J 13/03; B21D 22/14; B21D 53/10; B23P 23/02; G10K 11/161; F16L 55/02; B21C 23/186; F41A 21/30

USPC ..... 72/358, 324, 355.4, 347, 352, 359, 72/354.6, 355.2, 470, 471, 475, 455; 181/223, 296; 279/143, 145; 29/76.1; 89/14.4

See application file for complete search history.

(56) References Cited

U.S. PATENT DOCUMENTS 596,405 A * 12/1897 Hart ..... B21J 5/02 72/355.4
1,338,462 A * 4/1920 Rydbeck ..... B21K 1/04 29/898.066
2,414,292 A * 1/1947 Ewert ..... 408/112

(Continued)

*Primary Examiner* — Shelley Self
*Assistant Examiner* — Gregory Swiatocha
(74) *Attorney, Agent, or Firm* — Rylander & Associates, PC; Philip R. M. Hunt

(57) ABSTRACT

A device and a method of using the device for construction of baffles that may be used in suppressors or solvent traps for firearms out of metal cups sold as engine block freeze plugs. The device has a bottom die, a top die and an alignment cylinder. The metal cup is transformed into a baffle by placing the metal cup on the bottom die, placing the bottom die inside the alignment cylinder, placing the top die inside the alignment cylinder, and applying compressive forces to the bottom die and top die. A hole may be drilled in the center of the baffle by placing a drill bit into a top die center hole completely penetrating through the top die and coaxial thereto, and drilling through the baffle, the drill bit passing into a bottom die center hole penetrating at least partially into the bottom die and coaxial thereto.

11 Claims, 10 Drawing Sheets

(56) References Cited

U.S. PATENT DOCUMENTS 2,435,480 A * 2/1948 Tuttle ..... 279/2.03
2,815,791 A * 12/1957 Poska ..... 72/358
3,786,667 A * 1/1974 Garnett, Jr. ..... B21D 51/2646 72/348
4,172,341 A * 10/1979 Klein, Sr. ..... 451/398
4,964,903 A * 10/1990 Carpenter et al. ..... C03B 9/48 264/2.7
5,744,175 A * 4/1998 Steinberger et al. ..... 425/390
6,062,060 A * 5/2000 Nguyen ..... 72/317
6,591,648 B1 * 7/2003 Ash et al. ..... 72/55
7,624,611 B2 * 12/2009 Saitou ..... 72/349
2001/0037669 A1 * 11/2001 Tanaka et al. ..... B21J 5/02 72/355.6
2004/0016281 A1 * 1/2004 Schwager et al. ..... B21K 1/30 72/355.6
2010/0074700 A1 * 3/2010 Canino et al. ..... 408/16
2011/0016944 A1 * 1/2011 Tamai ..... 72/358
2012/0073350 A1 * 3/2012 Iwata et al. ..... 72/347
2012/0134027 A1 * 5/2012 Zou et al. ..... C03B 11/08 359/601

* cited by examiner

DEVICE AND METHOD FOR CONSTRUCTION OF BAFFLES FROM ENGINE BLOCK FREEZE PLUGS

FIELD OF THE INVENTION

The present invention relates to suppressors and solvent traps for firearms. More particularly, the present invention relates to a construction of baffles that may be used in suppressors or solvent traps.

BACKGROUND

A suppressor or a sound suppressor is a device that may be attached to the barrel of a firearm which reduces the amount of noise and visible muzzle flash generated when firing. While suppressors are desirable for stealth purposes, they are also desirable for mitigating noise pollution and lowering the risks of hearing loss.

Suppressors are typically constructed of a metal cylinder body with internal mechanisms that reduce the sound of firing by slowing the escaping propellant gas. The most common internal mechanisms are baffles. Baffles are typically circular metal dividers which separate the cylinder body into expansion chambers. A suppressor typically has multiple baffles. Each baffle has a hole in its center to permit the passage of the bullet. The hole is usually slightly larger than the bullet caliber to minimize the risk of the bullet hitting the baffle. Spacers typically separate the baffles and keep them aligned at a specified distance from each other inside the suppressor.

Suppressors are regulated by firearm legislation in most countries. While some countries allow civilian use of suppressors, other governments have opted to ban them from civilian use. In the United States, possession of suppressors is legal in most states, but regulations make purchasing them difficult. Regulations for making one's own suppressor are easier to comply with, and many people do make their own. The baffles are the key parts of the suppressor and individual baffles are treated as suppressors themselves. Hence one cannot buy suppressor baffles ready to be assembled into a suppressor or contract out the work of making them with any less regulatory difficulty than purchasing an entire suppressor.

Many designs for making a suppressor are available and if one has access to a fully equipped machine shop, particularly lathe tools, making one's own suppressor is not too difficult. However, many people do not have easy access to a fully equipped machine shop. Some suppressor designs are devised for people who have access to a limited set of tools.

Some popular suppressor designs that require minimal tools modify engine block freeze plugs to make the baffles. Engine block freeze plugs (or core plugs) are thin metal cups (see FIGS. 2*a* and 2*b*) used to plug holes left in the engine blocks of water-cooled internal combustion engines as part of the manufacturing process. Holes are put into the casting of an engine block to support internal sand forms, and to facilitate the removal of the sand after the casting has cooled. It is also thought that core plugs will pop out and protect the engine block from cracking in the event that the coolant water in the engine block freezes and expands. Hence core plugs are popularly called frost plugs, freeze plugs, or engine block expansion plugs. Freeze plugs are inexpensive, readily available through auto parts stores, and are not subject to firearms regulations.

To make baffles for a suppressor, freeze plugs are typically reformed from a cup that is "U" shaped in cross-section to a cup that has a conical depression in the middle with an "M" shaped cross-section. In some design methods, the conical depression is formed by drilling a hole in the center of the unmodified freeze plug, then putting it into a vise along with an object, such as a ball bearing, that has an increasing cross-section diameter that ultimately is somewhat larger in cross-section diameter than the center hole. The vise is then tightened and the freeze plug reformed into an "M" baffle. A socket from a wrench set can be used to hold the freeze plug during the compression in the vise. However, this method is not all that reliable. The center hole expands about 50% during the process, with a good deal of variation between each baffle made this way. It is highly desirable to have the center hole only slightly larger than the bullet. So this means that the finished baffles must be measured to ensure desired tolerances for the size of the center hole are met. Typically many do not and must be discarded. Alternatively, one can undersize the initial drilling of the center hole, then re-drill the center hole after the vise reforming. However, this is hard to do without a drill press using only a hand-held drill and still keep the center of the center hole in the center of the baffle. The finished baffles must be measured to ensure desired tolerances for the location of the center hole are met. Again, many typically will not and must be discarded.

What is needed is a simple and reliable method for making baffles from engine block freeze plugs using only simple hand tools and not high precision machine shop tools.

BRIEF DESCRIPTION OF THE DRAWINGS

The present invention will be described by way of exemplary embodiments, but not limitations, illustrated in the accompanying drawings in which like references denote similar elements, and in which.

The accompanying drawings, which are incorporated into and constitute a part of this specification, illustrate one or more embodiments of the invention and, together with the detailed description, serve to explain the principles and implementations of the invention.

DETAILED DESCRIPTION

Before beginning a detailed description of the subject invention, mention of the following is in order. When appropriate, like reference materials and characters are used to designate identical, corresponding, or similar components in different figures. The figures associated with this disclosure typically are not drawn with dimensional accuracy to scale, i.e., such drawings have been drafted with a focus on clarity of viewing and understanding rather than dimensional accuracy.

In the interest of clarity, not all of the routine features of the implementations described herein are shown and described. It will, of course, be appreciated that in the development of any such actual implementation, numerous implementation-specific decisions must be made in order to achieve the developer's specific goals, such as compliance with application and business related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

Use of directional terms such as "upper," "lower," "above," "below", "in front of," "behind," etc. are intended to describe the positions and/or orientations of various components of the invention relative to one another as shown in the various Figures and are not intended to impose limitations on any position and/or orientation of any embodiment of the invention relative to any reference point external to the reference.

Those skilled in the art will recognize that numerous modifications and changes may be made to the exemplary embodiment(s) without departing from the scope of the claimed invention. It will, of course, be understood that modifications of the invention, in its various aspects, will be apparent to those skilled in the art, some being apparent only after study, others being matters of routine mechanical, chemical and electronic design. No single feature, function or property of the exemplary embodiment(s) is essential. Other embodiments are possible, their specific designs depending upon the particular application. As such, the scope of the invention should not be limited by the particular embodiments herein described but should be defined only by the appended claims and equivalents thereof.

The Exemplary Embodiment

Structure

Figure 1:
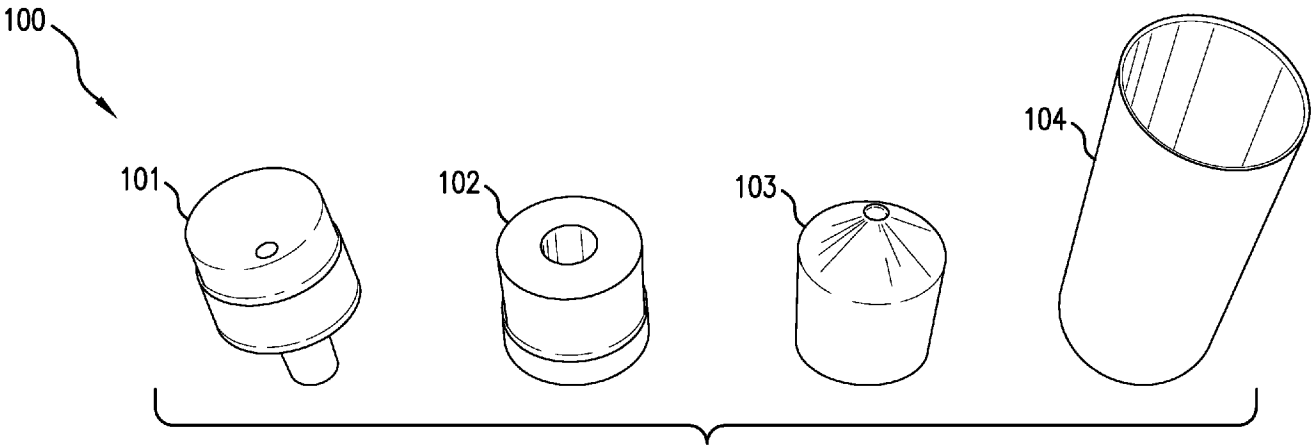
FIG. 1 shows a perspective view of an exemplary embodiment of a baffle forming device.
Figure 2B:
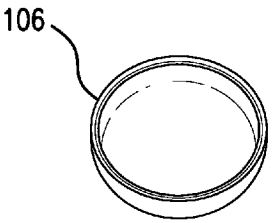
FIG. 2*b* shows a perspective bottom view of the same freeze plug.
Figure 2A:
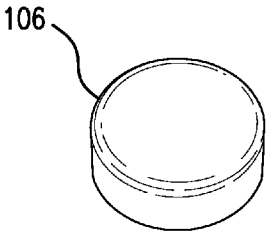
FIG. 2*a* shows a perspective top view of a freeze plug with which the baffle forming device is configured to work.
Figure 3:
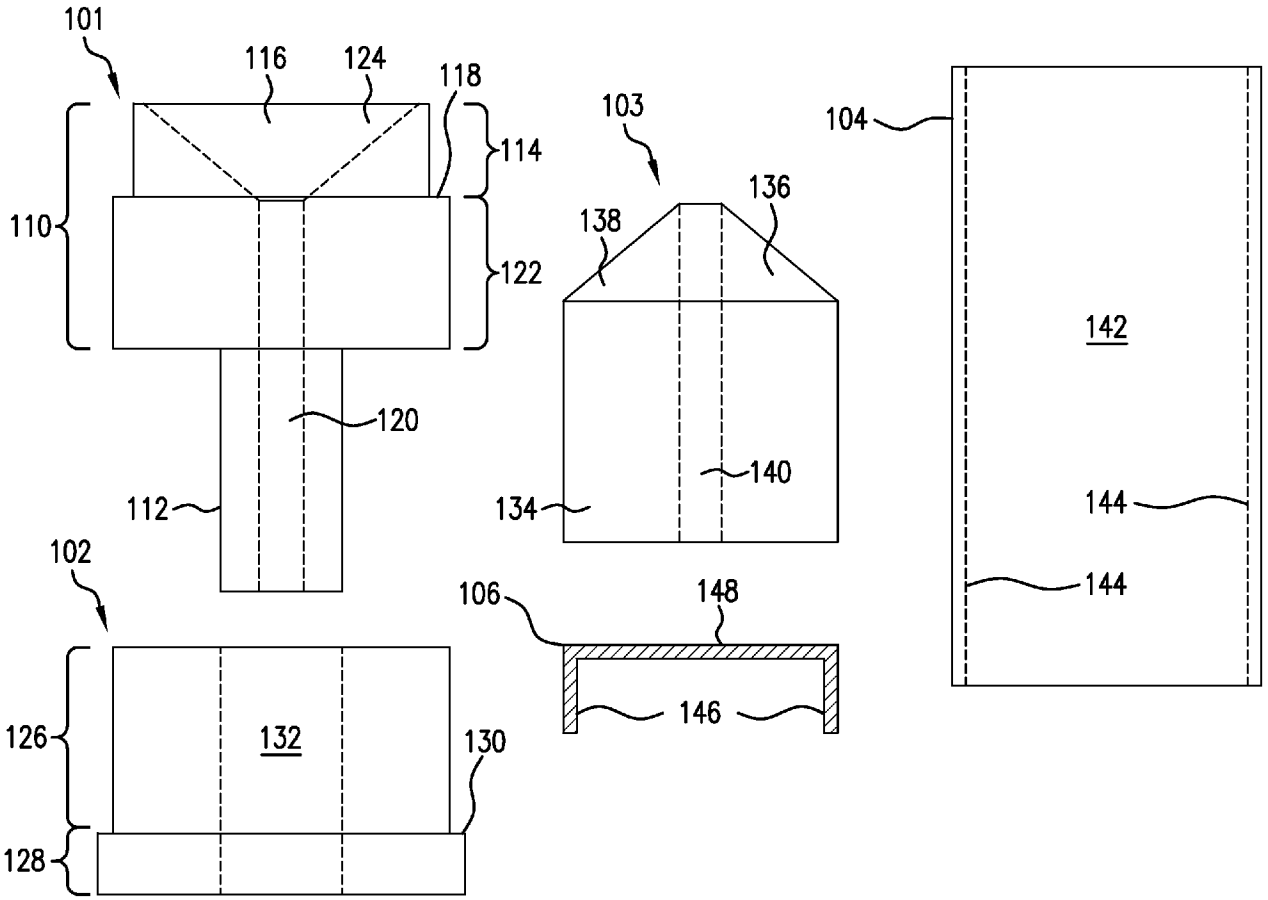
FIG. 3 shows sectional side views of the four components of the baffle forming device and the freeze plug.

FIG. 1 shows a perspective view of an exemplary embodiment of baffle forming device 100. The baffle forming device 100 has a bottom die 101, a bottom die holder 102, a top die 103, and an alignment cylinder 104. FIG. 2*a* shows a perspective top view of a freeze plug 106 with which the baffle forming device 100 is configured to work. FIG. 2*b* shows a perspective bottom view of the same freeze plug 106. FIG. 3 shows sectional side views of the four components of the baffle forming device 100 and the freeze plug 106. These four components of the baffle forming device 100 can be used to form the freeze plug 106 into an M-type baffle to be used in a suppressor. To make a baffle, the freeze plug 106 is placed on top of the bottom die 101 and the bottom die 101 is placed in the bottom die holder 102. The alignment cylinder 104 is placed over this assembly and the top die 103 is placed into the top of the alignment cylinder 104 (see FIG. 6). The assembled baffle forming device 100 and freeze plug 106 is then placed in a vice and compressed (see FIG. 7). Freeze plugs come in a variety of sizes, so a particular embodiment of the baffle forming device 100 will be dimensioned to accommodate a particular dimensioned freeze plug.

The Bottom Die

The bottom die 101 comprises a bottom die body 110 and a bottom die post 112, with the bottom die body 110 coupled to, and on top of, a bottom die post 112. The bottom die body 110 and the bottom die post 112 are both cylindrical and coaxial, with the bottom die body 110 having a larger diameter than the bottom die post 112. The bottom die post 112 is configured for mating with the bottom die holder 102. The bottom die post 112 is configured to be inserted into the chuck of a typical hand-held drill. As such, the diameter of the bottom die post 112 in the exemplary embodiment is about one half inch. In other embodiments, the bottom die post 112 may have a diameter with a different value.

The bottom die body 110 comprises a bottom die base 122 and a bottom die block 114, with the bottom die block 114 coupled to, and on top of, the bottom die base 122. The bottom die block 114 and the bottom die base 122 are both cylindrical and coaxial, with the bottom die base 122 having a slightly larger diameter than the bottom die block 114. The difference between the diameters of the bottom die block 114 and the bottom die base 122 forms a block notch 118. The bottom die block 114 is configured to hold the freeze plug 106. The bottom die block 114 has a diameter no wider than the inside diameter of the freeze plug 106 that it is designed to work with and a height at least the height of that freeze plug 106. The bottom die base 122 has a diameter about the same diameter as the outside diameter of the freeze plug 106, but less than the inside diameter of the alignment cylinder 104.

The bottom die body 110 has a conical cavity 116 coaxial thereto, with its base open to the top. The sides of the conical cavity 116 and its base form a cavity angle 124. The cavity angle 124 will determine the angle of the finished baffle. In the exemplary embodiment, the cavity angle 124 is about 40 degrees, but other embodiments may have different values for the cavity angle 124. In the exemplary embodiment, the conical cavity 116 is no deeper than the height of the freeze plug 106 and does not extend past the bottom die block 114 into the bottom die base 122. However, in other embodiments, the conical cavity 116 may be deeper than the height of the freeze plug 106 and extend into the bottom die base 122.

The bottom die 101 has a bottom die center hole 120 that is coaxial thereto. The bottom die center hole 120 joins the bottom of the conical cavity 116 and extends at least some distance into the bottom die base 122. The bottom die center hole 120 allows for drilling of a center hole in the freeze plug 106. In the exemplary embodiment, the bottom die center hole 120 extends all the way through the bottom of the bottom die post 112. This allows the freeze plug 106 to be attached to the bottom die 101 with a bolt after compression and drilling in preparation for grinding and filing. However, in other embodiments, the bottom die center hole 120 does not extend all the way through the bottom of the bottom die 101.

In the exemplary embodiment, the bottom die 101 is machined out of a monolithic piece of steel, but in other embodiments, may be made out of other suitable materials and the bottom die block 114, the bottom die base 122, and the bottom die post 112 may be formed separately, by machining, casting or other process, then joined by welding or some other suitable fastening mechanism.

The Bottom Die Holder

The bottom die holder 102 comprises a holder block 126 and a holder base 128. The holder block 126 and holder base 128 are both cylindrical and coaxial, with the holder base 128 having a slightly larger diameter than the holder block 126. The difference between the diameters of the holder block 126 and the holder base 128 forms a holder notch 130. The holder block 126 has a diameter that is no wider than the inside diameter of the alignment cylinder 104, allowing the holder block 126 to fit inside the alignment cylinder 104. The holder base 128 has a diameter at least as large as the outside diameter of the alignment cylinder 104, which prevents the holder base 128 from entering the alignment cylinder 104 and prevents the alignment cylinder 104 from sliding over and past the holder base 128.

The bottom die holder 102 is configured to hold the bottom die 101. To facilitate this, the bottom die holder 102 has a holder center hole 132 that is coaxial thereto. The bottom die holder 102 is configured to have the bottom die post 112 inserted into the holder center hole 132. The holder center hole 132 is as least as deep as the bottom die post 112 is long, so that the bottom die base 122 contacts the holder block 126, which will allow force to be uniformly transmitted through the bottom die holder 102 and bottom die 101 to the freeze plug 106. In the exemplary embodiment, the holder center hole 132 has a depth that is the same as the bottom die post 112 to allow force to be transmitted through the bottom die post 112 to the bottom die base 122 as well as through the holder block 126. However, in other embodiments, the holder center hole 132 may be deeper than the bottom die post 112, so that the bottom die post 112 does not transmit force, keeping it from being damaged during the compression process.

In the exemplary embodiment, the bottom die holder 102 is machined out of a monolithic piece of steel. In other embodiments, the bottom die holder 102 may be made out of other suitable materials and the holder block 126 and the holder base 128 may be formed separately, by machining, casting or other process, then joined by welding or some other suitable fastening mechanism. In yet other embodiments, the bottom die 101 and bottom die holder 102 are permanently joined together, made either from a monolithic piece or made separately and then joined by welding or some other suitable fastening mechanism.

The Top Die

The top die 103 comprises a top die base 134 and a top die block 136. The top die base 134 is cylindrical and has a diameter that is no larger than the inside diameter of the alignment cylinder 104, which allows the top die 103 to be inserted into the alignment cylinder 104. In the exemplary embodiment, the top die base 134 has a diameter that is only slightly less than the inside diameter of the alignment cylinder 104. The top die block 136 is shaped as a truncated cone with the base of the cone against the top of the top die base 134. and this value will determine the angle of the finished baffle. In the exemplary embodiment, the top die angle 138 is about 40 degrees, but other embodiments may have different values for the top die angle 138.

The top die 103 has a top die center hole 140 that is coaxial thereto. The top die center hole 140 allows for drilling of a center hole in the freeze plug 106. The top die center hole 140 extends all the way through the top die 103. However, in other embodiments the top die 103 does not have a top die center hole 140.

In the exemplary embodiment, the top die 103 is machined out of a monolithic piece of steel. In other embodiments, the top die 103 may be made out of other suitable materials and the top die base 134 and top die block 136 may be formed separately, by machining, casting or other process, then joined by welding or some other suitable fastening mechanism.

The Alignment Cylinder

The alignment cylinder 104 is a hollow cylinder with an alignment cylinder inner wall 144 around an alignment cavity 142 open on both cylinder ends. The alignment cylinder 104 is configured to allow the bottom die 101 holding the freeze plug 106 to be inserted into the alignment cavity 142 from one end and the top die 103 from the other end. The alignment cylinder inner wall 144 aligns the top die 103 and the bottom die 101 during the compression process. The alignment cylinder inner wall 144 also prevents the freeze plug side walls 146 from bowing outward during the compression process.

In the exemplary embodiment, the alignment cylinder 104 is an extruded piece of steel. In other embodiments, the alignment cylinder 104 may be made out of other suitable materials and may be formed by machining, casting or other process.

The Exemplary Embodiment

Operation

Figure 4:
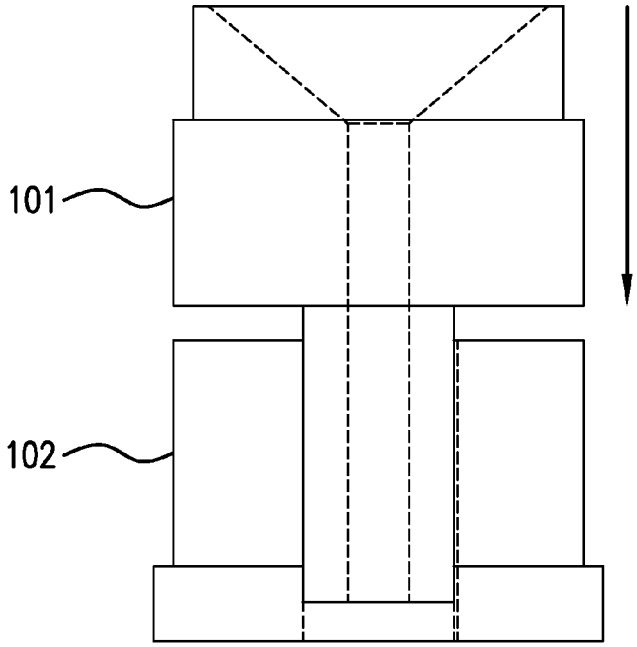
FIG. 4 shows a sectional side view of the bottom die being inserted into the bottom die holder.
Figure 5:
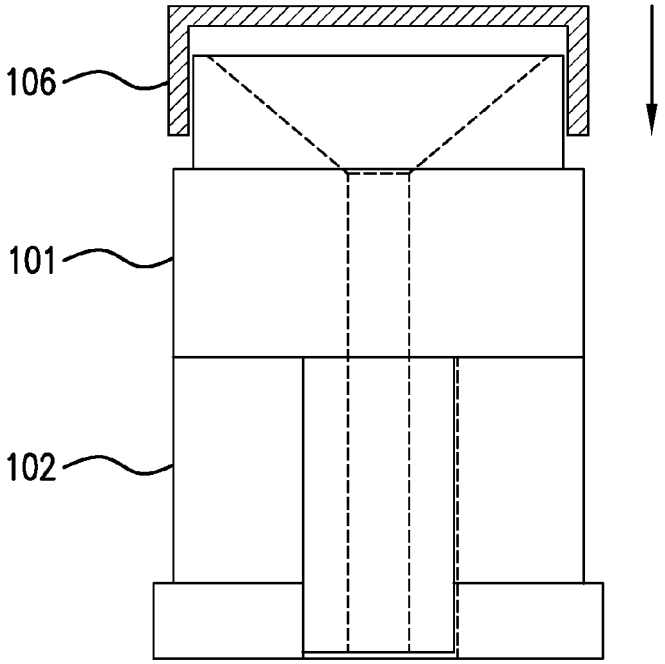
FIG. 5 shows a sectional side view of the freeze plug being place on top of the bottom die.

FIGS. 4-13 show steps of a method to make a baffle from a freeze plug 106 using the exemplary embodiment of the baffle forming device 100. FIG. 4 shows a sectional side view of the bottom die 101 being inserted into the bottom die holder 102. FIG. 5 shows a sectional side view of the freeze plug 106 being place on top of the bottom die 101.

Figure 6:
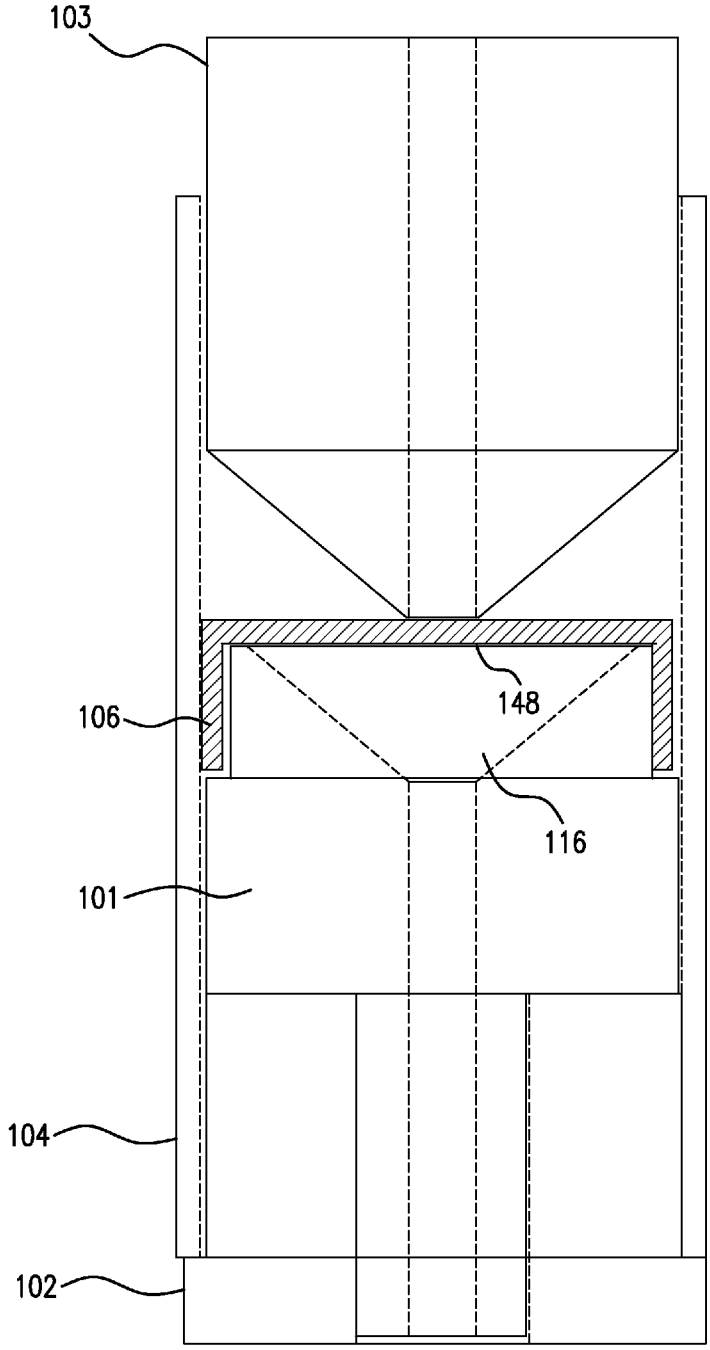
FIG. 6 shows a sectional side view of the assembled baffle forming device holding the freeze plug prior to compression.

FIG. 6 shows a sectional side view of the assembled baffle forming device 100 holding the freeze plug 106 prior to compression. The bottom die holder 102 and the bottom die 101 with the freeze plug 106 have been inserted into the alignment cylinder 104. The freeze plug 106 still has its original "U" shape. The top die 103 has been inverted with the top die block 136 facing downwards towards the freeze plug 106 and bottom die 101 and inserted into the alignment cylinder 104. The assembled baffle forming device 100 is then compressed in a vise (not shown) or similar compression providing device. The vise applies compression to the top die 103 and the bottom die holder 102, which transmits the force of compression to the bottom die 101. The freeze plug center wall 148 is deformed and forced down into the conical cavity 116 of the bottom die 101.

Figure 7:
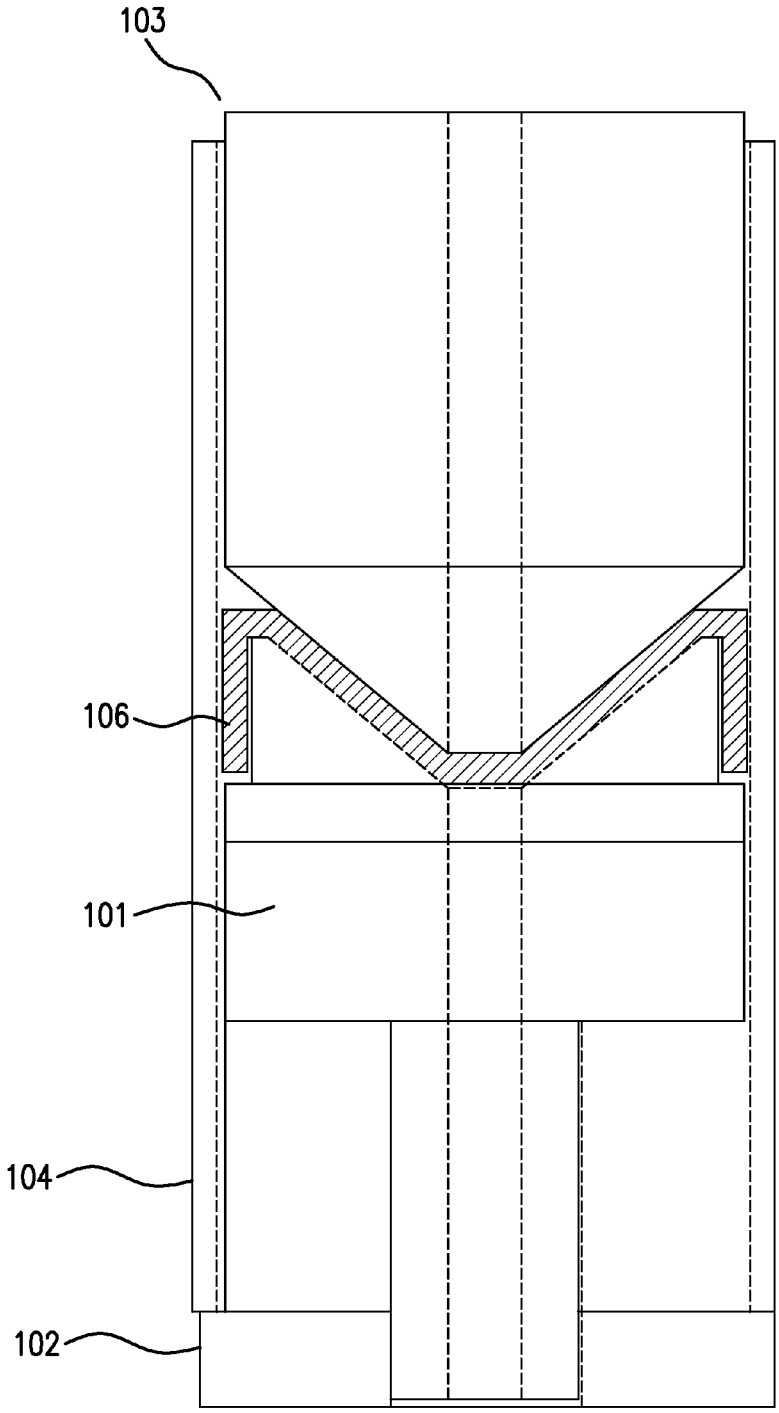
FIG. 7 shows a sectional side view of the assembled baffle forming device holding the freeze plug after compression.

FIG. 7 shows a sectional side view of the assembled baffle forming device 100 holding the freeze plug 106 after compression. The freeze plug 106 now has been formed into an "M" shape in cross-section. The top die 103 has penetrated deeper into the alignment cylinder 104 and has stopped when the conical cavity 116 has been completely filled with the freeze plug 106 and the top die 103.

Figure 8:
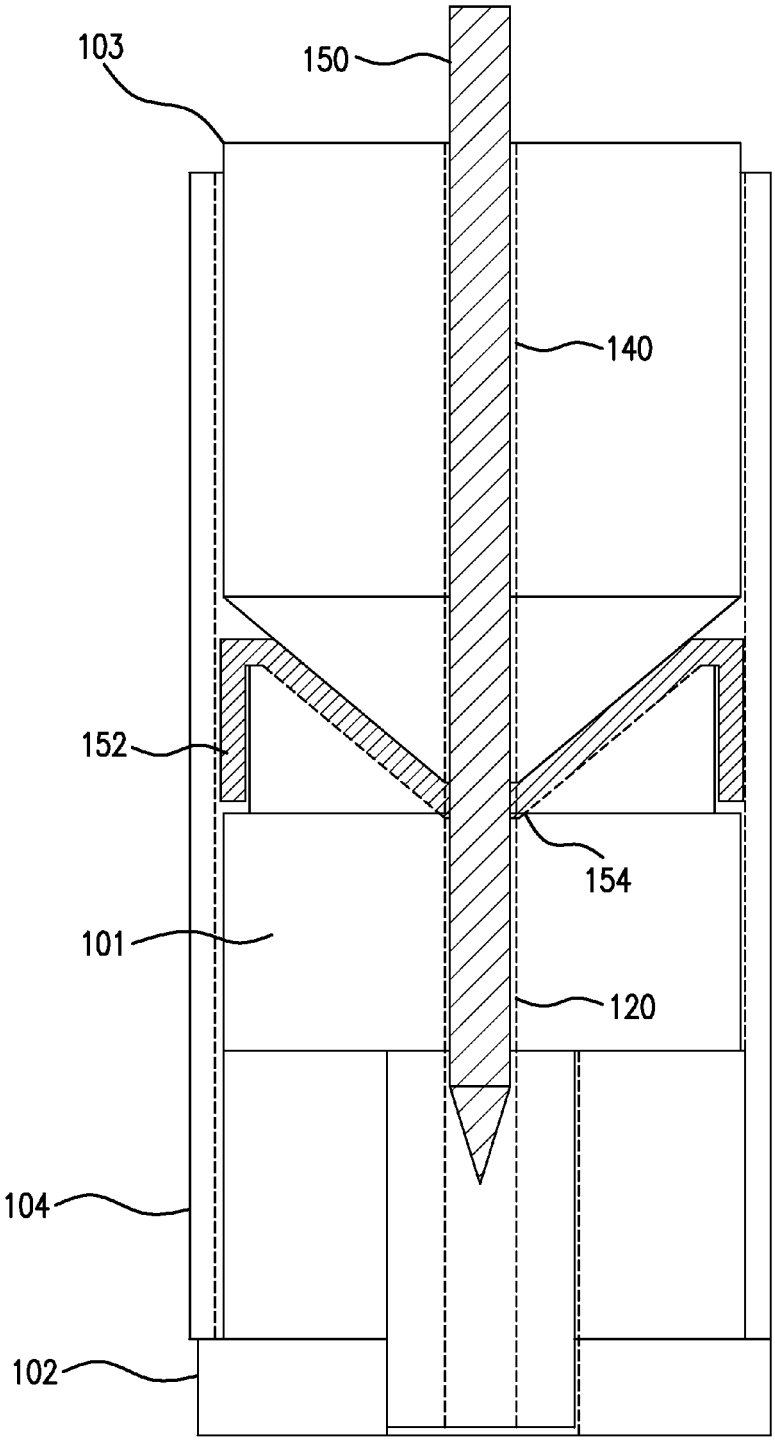
FIG. 8 shows a sectional side view of the assembled baffle forming device holding the freeze plug during drilling.

FIG. 8 shows a sectional side view of the assembled baffle forming device 100 holding the freeze plug 106 during drilling. A drill bit 150 has been inserted into the top die center hole 140, has cut through the freeze plug 106 (now a baffle 152) creating a baffle center hole 154, and penetrated beyond into the bottom die center hole 120. The drill bit 150 is then withdrawn and the top die 103 and alignment cylinder 104 removed.

Figure 9:
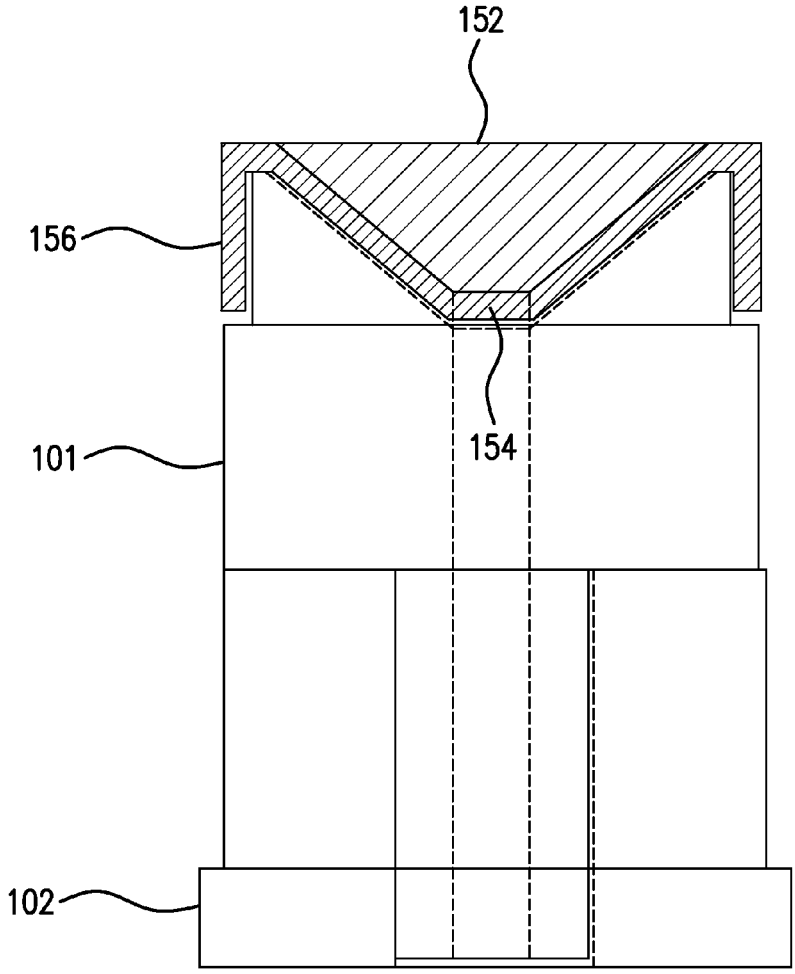
FIG. 9 shows a sectional side view of the bottom die holder and the bottom die holding the baffle.

FIG. 9 shows a sectional side view of the bottom die holder 102 and the bottom die 101 holding the baffle 152. The top die 103 and alignment cylinder 104 have been removed. The baffle 152 has its final shape, but its outside diameter may have expanded slightly during the compression process. This may be corrected by filing or grinding off some of the baffle side wall 156.

Figure 10:
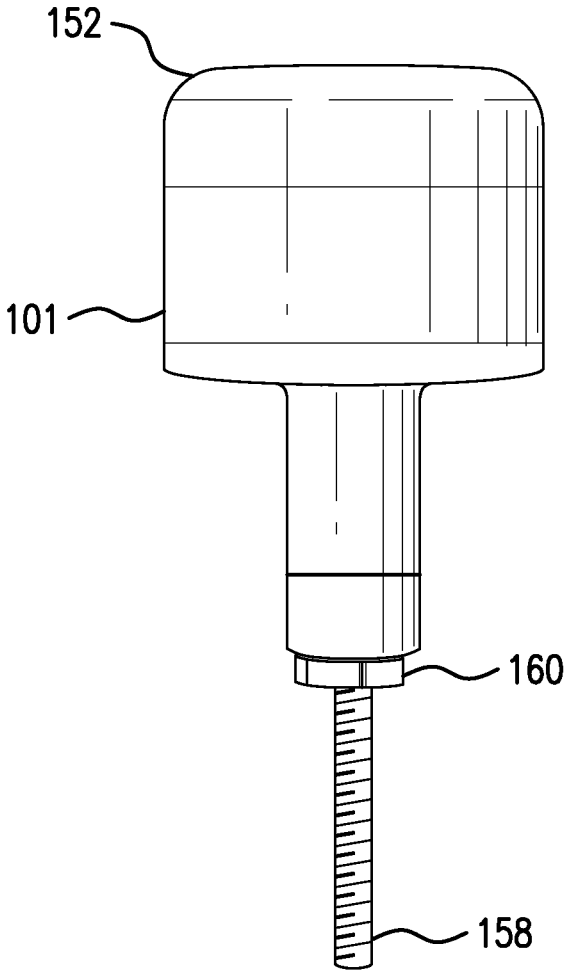
FIG. 10 shows a side view of the bottom die bolted to the baffle with a bolt and secured with a bolt.

FIG. 10 shows a side view of the bottom die 101 bolted to the baffle 152 with a bolt 158 and secured with a nut 160. The bolt 158 will keep the bottom die 101 and baffle 152 together during the grinding/filing process.

Figure 11:
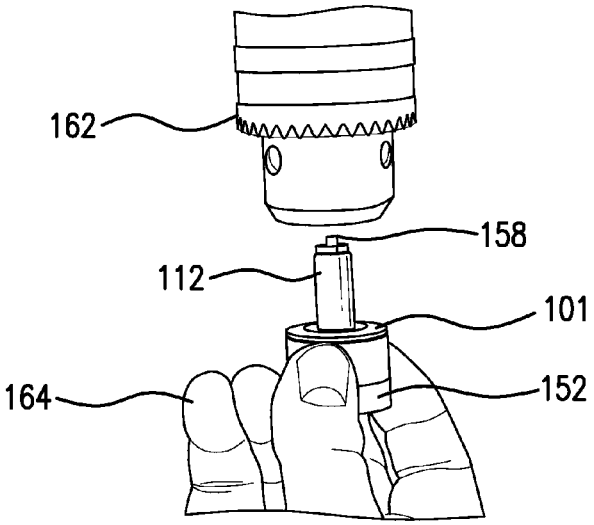
FIG. 11 shows a side view of a user inserting the bottom die post into a drill chuck.
Figure 12:
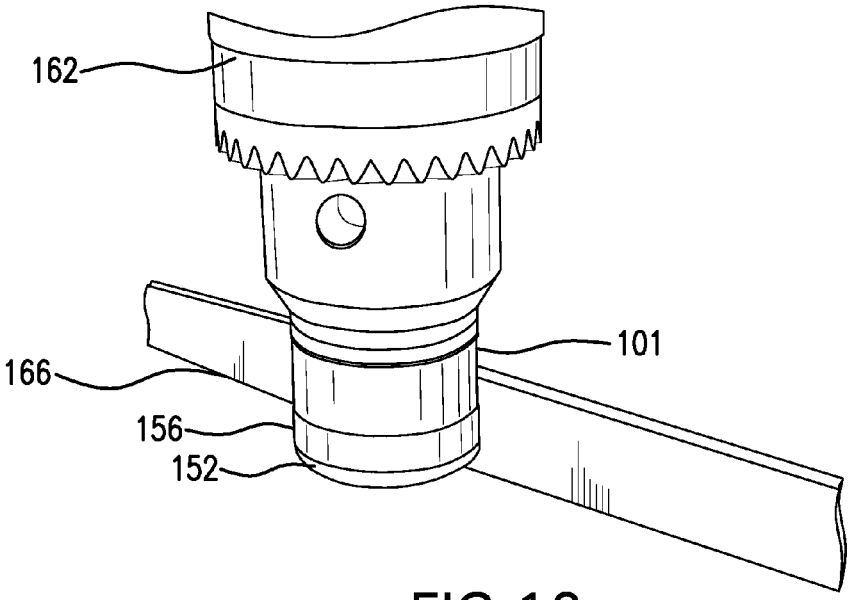
FIG. 12 shows a side view of the process of filing down the baffle side wall.
Figure 13:
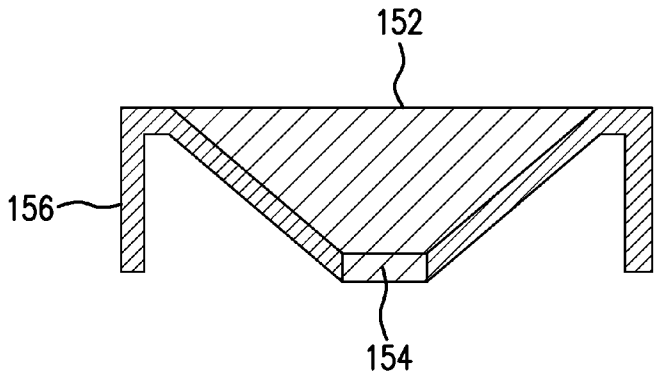
FIG. 13 shows a sectional side view of the finished baffle.
Figure 14:
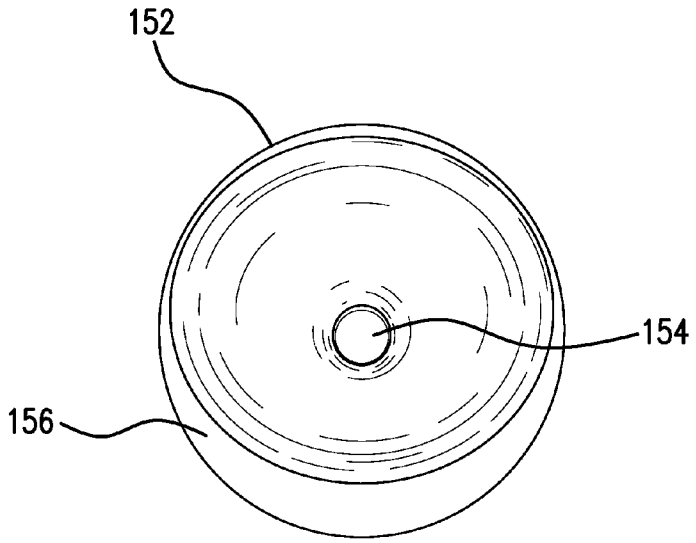
FIG. 14 shows a top perspective view of the finished baffle.

FIG. 11 shows a side view of a user 164 inserting the bottom die post 112 into a drill chuck 162. The drill chuck 162 may be part of a drill press or may be part of a hand drill either held in the user's 164 other hand or in a vise. FIG. 12 shows a side view of the processes of filing down the baffle side wall 156. The drill is run, spinning the bottom die 101 and baffle 152 assembly. A hand file 166 can be held against the baffle side wall 156 to file it down to the proper size. FIG. 13 shows a sectional side view of the finished baffle 152. FIG. 14 shows a top perspective view of the finished baffle 152.

What is claimed is:

1. A baffle forming device comprising:

an alignment cylinder with an alignment cylinder cavity therein that is cylindrical and has open ends, the alignment cavity with an alignment cylinder inside diameter;

a bottom die with a bottom die body having a bottom die block coupled to a bottom die base, wherein the bottom die is a monolithic piece, wherein the bottom die block and the bottom die base are cylindrical and coaxial, wherein the bottom die base has a bottom die base outside diameter and the bottom die block has a bottom die block outside diameter, wherein the bottom die base outside diameter is larger than the bottom die block outside diameter and no larger than the alignment cylinder inside diameter, wherein the bottom die block has a conical cavity therein and coaxial with the bottom die, the conical cavity with a conical cavity base that is open, wherein the bottom die has a bottom die center hole that is coaxial with the bottom die, wherein the bottom die center hole joins the bottom of the conical cavity and extends at least partially into the bottom die base, wherein the conical cavity has conical cavity sides, wherein the conical cavity sides and the conical cavity base define a bottom die cavity angle;

a top die with a top die base coupled to a top die block, wherein the top die base is cylindrical and has a top die base diameter that is no larger than the alignment cylinder inside diameter, wherein the top die block is shaped as a truncated cone, wherein the top die block has a top die block conical base that is adjacent to the top die base, wherein the top die has a top die center hole that is coaxial with the top die, wherein the top die center hole extends completely through the top die, wherein the top die block has top die block sides, wherein the top die block sides and the top die block conical base defined a top die angle, wherein a value of the top die angle matches a value of the cavity angle; and wherein the top die and the bottom die are configured to fit slidingly within the alignment cylinder cavity.

2. The baffle forming device of claim 1, wherein:

the bottom die further comprises a bottom die post coupled to the bottom die body, wherein the bottom die post is coaxial with the bottom die block, wherein the bottom die post has a bottom die post maximum width smaller than the bottom die block outside diameter;

the baffle forming device further comprises a bottom die holder; and the bottom die holder comprises a holder block coupled to a holder base, wherein the holder block and the holder base are cylindrical and coaxial, wherein the holder block has a holder block diameter and the holder base has a holder base diameter, wherein the holder block diameter is smaller than the holder base diameter and smaller than the alignment cylinder inside diameter, wherein the holder block and the holder base have a holder center hole coaxial with the holder block and the holder base, wherein the holder center hole has a holder center hole maximum width that is at least as large as the bottom die post maximum width.

3. The baffle forming device of claim 2, wherein:

the bottom die post is configured to fit slidingly within the holder center hole.

4. The baffle forming device of claim 2, wherein:

the holder block is configured to fit slidingly within the alignment cylinder cavity.

5. A method for making a baffle for a firearm suppressor from a metal cup, comprising the steps of:

providing an alignment cylinder with an alignment cylinder cavity therein that is cylindrical and has open ends, the alignment cavity with an alignment cylinder inside diameter;

providing a bottom die with a bottom die body and a bottom die post, the bottom die body having a bottom die block coupled to a bottom die base, wherein the bottom die is a monolithic piece, wherein the bottom die block and the bottom die base are cylindrical and coaxial, wherein the bottom die base has a bottom die base outside diameter and the bottom die block has a bottom die block outside diameter, wherein the bottom die base outside diameter is larger than the bottom die block outside diameter and no larger than the alignment cylinder inside diameter, wherein the bottom die block has a conical cavity therein and coaxial with bottom die, the conical cavity with a conical cavity base that is open wherein the bottom die post is coaxial with the bottom die block, wherein the bottom die post has a bottom die post maximum width smaller than the bottom die block outside diameter;

providing a bottom die holder comprising a holder block coupled to a holder base, wherein the holder block and the holder base are cylindrical and coaxial, wherein the holder block has a holder block diameter and the holder base has a holder base diameter, wherein the holder block diameter is smaller than the holder base diameter and smaller than the alignment cylinder inside diameter, wherein the holder block and the holder base have a holder center hole coaxial with the holder block and the holder base, wherein the holder center hole has a holder center hole maximum width that is at least as large as the bottom die post maximum width;

providing a top die with a top die base coupled to a top die block, wherein the top die base is cylindrical and has a top die base diameter that is no larger than the alignment cylinder inside diameter, wherein the top die block is shaped as a truncated cone, wherein the top die block has a top die block conical base that is adjacent to the top die base;

placing the metal cup on the bottom die;

placing the bottom die post inside, and in sliding contact with, the holder center hole;

placing the bottom die and bottom die holder inside, and in sliding contact with, the alignment cylinder;

placing the top die inside, and in sliding contact with, the alignment cylinder;

applying compressive forces to the bottom die and top die, thereby transforming the metal cup into the baffle; and making the firearm suppressor using the baffle as a component.

6. The method of claim 5, wherein:

the step of applying compressive forces further comprises using a vise.

7. The method of claim 5, further comprising the steps of:

placing a drill bit into a top die center hole, the top die center hole completely penetrating through the top die and coaxial with the top die; and drilling through the baffle, the drill bit passing into a bottom die center hole, the bottom die center hole penetrating at least partially into the bottom die and coaxial with the top die.

8. The method of claim 7, wherein:

the step of drilling through the baffle further comprises using a hand-held drill to drive the drill bit.

9. The method of claim 7, further comprising the steps of:

removing the bottom die from the alignment cylinder;

removing the bottom die from the bottom die holder;

attaching the baffle to the bottom die with a fastener through the baffle and into the bottom die center hole;

attaching the bottom die post to a chuck of a drill;

spinning the baffle using the drill; and shaping the baffle while spinning.

10. The method of claim 9, wherein:

the step of shaping the baffle while spinning further comprises using a hand-held file.

11. The method of claim 9, wherein:

the fastener is a nut and threaded bolt; and the step of attaching the baffle to the bottom die with the fastener further comprises passing the threaded bolt completely through the baffle and the bottom die and securing the threaded bolt to the bottom die with the nut.

* * * * *